US006308156B1

(12) United States Patent
Barry et al.

(10) Patent No.: US 6,308,156 B1
(45) Date of Patent: Oct. 23, 2001

(54) MICROSEGMENT-BASED SPEECH-SYNTHESIS PROCESS

(75) Inventors: William Barry, Dudweiler; Ralf Benzmüller, Fischbach; Andreas Luning, Herne, all of (DE)

(73) Assignee: G Data Software GmbH, Bochum (DE)

( * ) Notice: Subject to any disclaimer, the term of this patent is extended or adjusted under 35 U.S.C. 154(b) by 0 days.

(21) Appl. No.: 09/142,728

(22) PCT Filed: Mar. 8, 1997

(86) PCT No.: PCT/DE97/00454

§ 371 Date: Sep. 14, 1998

§ 102(e) Date: Sep. 14, 1998

(87) PCT Pub. No.: WO97/34291

PCT Pub. Date: Sep. 18, 1997

(30) Foreign Application Priority Data

Mar. 14, 1996 (DE) ..... 196 10 019

(51) Int. Cl.[7] ..... G10L 13/06

(52) U.S. Cl. ..... 704/268; 704/251; 704/254; 704/258

(58) Field of Search ..... 704/268, 267, 704/258

(56) References Cited

U.S. PATENT DOCUMENTS

| | | | | |
|---|---|---|---|---|
| 4,489,433 | * | 12/1984 | Suehiro et al. | 704/201 |
| 5,220,629 | * | 6/1993 | Kosaka | 704/208 |
| 5,615,300 | * | 3/1997 | Hara et al. | 704/260 |
| 5,617,507 | * | 4/1997 | Lee et al. | 704/200 |
| 5,715,368 | * | 2/1998 | Saito et al. | 704/268 |
| 5,864,812 | * | 1/1999 | Kamai et al. | 704/268 |
| 5,878,396 | * | 3/1999 | Henton | 704/276 |

FOREIGN PATENT DOCUMENTS

| | | |
|---|---|---|
| 27 40 520 | 4/1978 | (DE) . |
| 0 144 731 | 6/1985 | (EP) . |
| WO 85/04747 | 10/1985 | (WO) . |
| WO 94/17519 | 8/1994 | (WO) . |

OTHER PUBLICATIONS

Cosgrove et al, "Formant Transition Detection in Isolated Vowels with Transitions In Initail and Final Position", IEEE, 1989.*

Martland et al, "Analysis of Ten Vowel Sounds Across Gender and Regional/Cultural Accent", 1996.*

Bhaskararao et al, "Use of Triphonse for Demisyllable Based Speech Segments", IEEE1991.*

Esprit Project 2589 (SAM), Multi–lingual Speech Input/Output Assessment . . . Final, Feb. 1992, pp. 1–39 (enclosed).

IEEE Transactions on Acoustics, Speech and Signal Processing, vol. 37, No. 12, Dec. 1, 1989, pp. 1829–1845, XP000099485, EL–Imam Y A: An Unrestricted Vocabulary Arabic Speech . . . (SR).

* cited by examiner

*Primary Examiner*—Fan Tsang
*Assistant Examiner*—Michael N. Opsasnick
(74) *Attorney, Agent, or Firm*—Collard & Roe, P.C.

(57) ABSTRACT

A digital speech synthesis process in which utterances in a language are recorded, and the recorded utterances are divided into speech segments which are stored so as to allow their allocation to specific phonemes. A text which is to be output as speech is converted to a phoneme chain and the stored segments are output in a sequence defined by the phoneme chain. An analysis of the text to be output as speech is carried out and thus provides information which completes the phoneme chain and modifies the timing sequence signal for the speech segments which are to be strung together for output as speech. The process uses microsegments consisting of: segments for vowel halves and semi-vowels and extending as far as the vowel middle, and a second vowel half from the vowel middle to just before the vowel end; segments for quasi-stationary vowel components cut from the middle of a vowel; consonant segments beginning shortly before the front phoneme boundary and ending shortly before the rear phoneme boundary; and segments for vowel-vowel sequences cut from the middle of a vowel-vowel transition.

14 Claims, 5 Drawing Sheets

MICROSEGMENT-BASED SPEECH-SYNTHESIS PROCESS

BACKGROUND OF THE INVENTION

1. Field of the Invention

The invention relates to a digital speech-synthesis process.

2. The Prior Art

Three processes are essentially known in the synthetic generation of speech with computers.

In formant synthesis, the resonance properties of the human vocal tract and its variations in the course of speaking, which are caused by the movements of the speech organs, are simulated by a filtered excitation signal. Such resonances are characteristic of the structure of vowels and their perception. For limiting the computing expenditure, the first three to five formants of a speech are generated synthetically with the excitation source. Therefore, with this type of synthesis, the memory location requirements in a computer are low. Furthermore, a simple change can be realized in duration and in the fundamental of the rule set excitation waveforms. However, the drawback is that an extensive rule set is needed for speech synthesis output, which often requires the use of digital processors. Furthermore, it is a disadvantage that the speech output sounds unnatural and metallic, and that it has special weak points in connection with nasals and obstruents, i.e., with plosives /p, t, k, b, d, g/, affricates /pf, ts, tS/ and fricatives /f, v, s, z, S, Z, C, j, x, h/.

In the present text, the letters shown between slashes (//) represent sound symbols according to the SAMPA-notation; cf: Wells, J.; Barry, W. J.; Grice, M.; Fourcin, A.; Gibbon, D. [1992]; Standard Computer-Compatible Transcription, in: ESPRIT PROJECT 2589 (SAM); Multi-Lingual Speech Input/ Output Assessment, Methodology and Standardization; Final Report; Doc. SAM-UCL-037, pp 29 ff.

In articulatory synthesis, the acoustic conditions in the vocal tract are modeled, so that the articulatory gestures and movements during speaking are simulated mathematically. Thus an acoustic model of the vocal tract is computed, which leads to substantial computing expenditure and which requires a high computing capacity. However, the automatic speech generated this way still sounds unnatural and technical.

Furthermore, the concatenation synthesis is known, where parts of really spoken utterances are concatenated in such a way that new utterances are generated. The individual speech segments thus form units for the generation of speech. The size of the segments may reach from words and phrases up to parts of sounds depending on the field of application. Demi-syllables or smaller demi-units can be used for speech synthesis with an unlimited vocabulary. Larger units are useful only if a limited vocabulary is to be synthesized.

In systems which do not use resynthesis, the choice of the correct cutting point of the speech components is decisive for the synthesis quality, and melodic and spectral jumps have to be avoided. Concatenative synthesis processes then achieve—especially with larger units—a more natural sound than the other methods. Furthermore, the controlling expenditure for generating the sounds is quite low. The limitations of this process lie in the relatively high memory requirements for the speech components needed. Another limitation of this process is that components, once recorded, can be changed (e.g. in duration or frequency) in the known systems only by costly resynthesis methods, which, furthermore, have an adverse effect on the sound of the speech and its comprehensibility. For this reason, also a number of different realizations of a speech unit are recorded, which, however, increases memory requirements.

The concatenation synthesis processes essentially comprise four synthesis methods permitting the speech synthesis without limitation of the vocabulary.

A concatenation of sounds or phones is carried out in phone synthesis. For Western European languages with a sound inventory of about 30 to 50 sounds and an average sound duration of about 150 ins, the memory requirements are acceptably low. However, these speech signal units lack the perceptively important transitions between the individual sounds, which, furthermore, can be recreated only incompletely by fading over individual sounds or even more complicated resynthesis methods. The quality of synthesis is, therefore, not satisfactory. Even storing allophonic variants of sounds in separate speech signal units in the so called allophone synthesis does not significantly enhance the speech result due to disregard of the articulatory-acoustic dynamics.

The most widely applied form of concatenation synthesis is the diphone synthesis, which employs speech signal units reaching from the middle of an acoustically defined speech sound up to the middle of the next speech sound. The perceptually important transitions from one sound to the next are taken into account in this way, such transitions appearing in the acoustic signal as a result of the movements of the speech organs. Furthermore, the speech signal units are thus concatenated at spectrally relatively constant places, which reduces the potentially present interferences of the signal flow on the joints of the individual diphones. The sound inventory of Western European languages consists of 35 to 50 sounds. For a language with 40 sounds, this theoretically results in 1600 pairs of diphones, which are then really reduced to about 1000 by phonotactic constraints. In natural speech, unstressed and stressed sounds differ in sound quality and duration. Different diphones are recorded in some systems for stressed and unstressed sound pairs in order to adequately take said differences into account in the synthesis. Therefore, 1000 to 2000 diphones with an average duration of about 150 ms are required depending on the projected configuration, resulting in a memory requirement for the speech signal units of up to 23 MB depending on the requirements with respect to dynamics and signal bandwidth. A common value amounts to approximately 8 MB.

The triphone and the demi-syllable syntheses are based on a principle similar to the one of the diphone synthesis. In this case too, the cutting point is disposed in the middle of the sounds. However, larger units are covered, which permits taking into account larger phonetic contexts. However, the number of combinations increases proportionally. In demi-syllable synthesis, one cutting point for the units used is in the middle of the vowel of a syllable. The other cutting point is at the beginning or at the end of a syllable, so that depending on the syllable structure, speech signal units can consist of sequences of several consonants. In German, about 52 different sound sequences exist in starting syllables of morphemes, and about 120 sound sequences for medial or final syllables of morphemes, resulting in a theoretical number of 6240 demi-syllables for the German language, of which some are uncommon. As demi-syllables are mostly longer than diphones, the memory requirements for speech signal units exceed those with diphones considerably.

The substantial memory requirements therefore pose the greatest problem in connection with a high-quality speech synthesis system. For reducing these requirements, it has been proposed, for example to exploit the silence in the closure of plosives for all plosive closures. A speech synthesis system is known from EP 0 144 731 Bl, where segments of diphones are used for several sounds. Said document describes a speech synthesizer which stores speech signal units which are generated by dividing a pair of sounds and relates such units with defined expression symbols. A synthesizing device reads the standard speech signal units from the memory in accordance with the output symbols of the converted sequence of expression symbols. Based on the speech segment of the input symbols it is determined whether two read standard speech signal units are connected directly when the input speech segment of the input symbols is voiceless, or whether a preset first interpolation process is applied when the input speech segment of the input symbol is voiced, the same standard signal unit being used both for a voiced sound /g, d, b/ and for its corresponding voiceless sound /k, t, p/. Furthermore, standard speech signal units representing the vowel segment after a consonant or the vowel segment preceding a consonant are to be stored in the memory as well. The transition ranges from a consonant to a vowel, or from a vowel to a consonant, can be equated in each case for the consonants k and g, t and d, as well as p and b. Respectively the memory requirements are reduced in this way; however, the aforementioned interpolation process requires a not insignificant computing expenditure.

A process for the synthesis of speech is known from DE 27 40 520 Al, in which each phone is formed by a phoneme stored in a memory, periods of sound oscillations being obtained from natural speech or are synthesized artificially. The text to be synthesized is grammatically and phonetically analyzed sentence by sentence according to the rules of the language. In addition to the periods of the sound oscillations, each phoneme is opposed to certain types and a number of time slices of noise phonemes with the respective duration, amplitude, and spectral distribution. The periods of the sound oscillations and the elements of the noise phonemes are stored in a memory in the digital form as a sequence of amplitude values of the respective oscillation, and are changed in the reading process according to the frequency characteristic or in order to increase the naturalness.

Accordingly, a digital speech synthesis process according to the concatenation principle and conforming to the introductory part of patent claim 1 is known from that document.

So as to make memory requirements as low as possible, individual periods of sound oscillations with characteristic formant distribution are stored according to the synthesis process of DE 27 40 520 Al. While maintaining the basic characteristics of the sentence, the types and the number of stored periods of sound oscillations associated with each phoneme are determined and then jointly form the acoustic speech impression. Accordingly, extremely short units of the length of a period of the basic oscillation of a sound are recalled from the memory and successively repeated depending on the number of repetitions previously determined. In order to realize smooth phoneme transitions synthetic periods with formant distributions which correspond to the transition between phonemes are used, or the amplitudes within the range of the respective transitions are reduced.

The drawback is that no adequate naturalness of the speech reproduction is achieved, because of the multiple reproduction of identical period segments, which may be reduced or extended only synthetically, if need be. Moreover, the substantially reduced memory requirements are gained at the expense of increased analysis and interpolation expenditure, costing computing time.

A process similar to the speech-synthesis process of DE 27 40 520 Al is known from WO 85/04747, which, however, is based on a completely synthetic generation of the speech segments. The speech segments, which represent phonemes or transitions, are generated from synthetic waveforms, which are reproduced repeatedly in a predetermined manner, if necessary reduced in length and/or voiced. Especially at phoneme transitions, an inverted reproduction of certain units is used as well. It is a drawback also in this process that even though the memory location requirements are considerably reduced, a substantial computing capacity is required due to extensive analyzing and synthesizing processes. Furthermore, the speech reproduction lacks the natural variance.

SUMMARY OF THE INVENTION

Therefore, the problem of the invention is to specify on the basis of DE 27 40 520 Al a speech-synthesis process in which high-quality speech output is achieved with low memory requirements and without high computing costs.

According to the speech-synthesis process as defined by the invention, a generalization is achieved in the use of the speech signal units in the form of microsegments. Thus it is avoided to apply separate speech signal units for each of the possible combinations of two speech signal units as required in diphone synthesis. The microsegments required for the speech output can be classified in three categories, which are:

1. Segments for vowel halves and semi-vowel halves which, in the dynamics of the spectral structure, indicate the movements of the speech organs from or to the place of articulation of the adjacent consonant. Consonant-vowel-consonant sequences are frequently found due to the syllable structure of most languages. Since, due to the relatively unmovable parts of the vocal tract, the movements are comparable for a given place of articulation, irrespective of the manner of articulation i.e. independently of the preceding or the following consonant type, only one microsegment is required for each vowel per global place of articulation of the preceding consonant (=first half of the vowel), and one microsegment per place of articulation of the following consonant (=second half of the vowel).
2. Segments for quasi-stationary vowel parts: These segments are separated from the middle of long vowel realizations which are perceived in terms of sound quality relatively constantly. Said segments are inserted in various contexts, for example at the beginning of the word, after the semi-vowel segments following certain consonants or consonant sequences, in German for example after /h/, /j/, as well as /?/, for phrase-final lengthening, between non-diphthongal vowel-vowel sequences, and in diphthongs as target positions.
3. Consonantal segments: The consonantal segments are formed in such a way that they can be used irrespectively of the type of adjacent sounds either generally for several occurrences of the sound, or in context with certain sound groups as especially in connection with plosives.

Of importance is that the microsegments classified in three categories can be used multiple times in different phonetic contexts, i.e., that the perceptually important transitions from one sound to the other in sound transitions are taken into account without separate acoustic units being required for each of the possible combinations of two speech sounds. The division in microsegments as defined by the invention, permits the application of identical units for different sound transitions for a group of consonants. With this principle of generalization in the application of speech signal units, the memory requirements for storing the speech signal units is reduced; however, the quality of the synthetically output speech is nevertheless very good because the perceptually important sound transitions are taken into account.

Because segments are identical for vowel halves and semi-vowel halves in one consonant-vowel or vowel-consonant sequence, for each of the global places of articulation of the adjacent consonants, namely labial, alveolar or velar, multiple utilization of the microsegments for different sound contexts is made possible with the speech segments for vowels, which means that a substantial reduction is achieved in the memory requirements.

If the segments for quasi-stationary vowel components are provided for vowels at the beginning of words as well as for vowel-vowel sequences, a substantial enhancement of the tonal quality of the synthetic speech is achieved for word starts, diphthongs or vowel-vowel sequences with a low number of additional microsegments.

Further generalization of the speech segments is obtained because consonantal segments for plosives are divided in two microsegments: a first segment comprising the closure phase and a second segment comprising the release phase. In particular, the closure phase can be represented by a series of statistical values of zeros for all plosives. No memory location is therefore required for this part of the sound reproduction.

The release phase of the plosives is differentiated according to the sound following in the context. Further generalization can be obtained in this connection in that a distinction is made in the release into vowels only based on the following four vowel groups: front unrounded vowels; front rounded vowels; low or centralized vowels; and back rounded vowels; and in a release into consonants only based on three different articulation places: labial alveolar or velar, so that for instance for German language, 42 microsegments have to be stored for the six plosives /p, t, k, b, d, g/ for the three consonant groups after the articulation place, and for four vowel groups. This reduces the memory requirements further due to the multiple use of microsegments in different phonetic contexts.

This has the advantage that, when a vowel segment is shortened, the start position is always reached with a vowel extending from a place of articulation towards the middle of a vowel and the end position is always reached with a vowel segment extending from the middle of the vowel towards the following articulation place, whereas the trajectory towards or from the "center of the vowel" is shortened. Such shortening of microsegments simulates, for example unstressed syllables, reflecting deviations from the spectral target quality of the respective vowel found in the natural, running speech and thus increasing the naturalness of the synthetic speech. Furthermore, it is advantageous in this connection, that no further memory for the segments is needed for such linguistic variations.

A manipulation of the microsegments is achieved with the analysis of the text to be spoken, such manipulation depending on the result of the analysis. It is possible in this way to reproduce such modifications of the pronunciation in dependence of the structure of the sentence and the semantics both sentence by sentence and word by word within sentences without requiring additional microsegments for different pronunciations. The memory requirements can thus be kept low. Furthermore, the manipulation in the time domain does not require any extensive computing procedures. The speech generated by the speech-synthesis process has nevertheless a very good natural quality.

In particular, it is possible by means of the analysis to detect speech pauses in the text to be output as speech. The phoneme string is extended in said places with pause symbols to form a symbol string, digital zeros being inserted on the pause symbols in the series of statistical values signal when the microsegments are concatenated. The additional information about a pause position and its duration is determined based on the sentence structure and predetermined rules. The pause duration is realized by the number of digital zeros to be inserted in dependence of the sampling rate.

Because the analysis detects phrase boundaries and the phoneme string is extended to a symbol string by introducing lengthening symbols at the phrase boundaries, phrase-final lengthening can be simulated in speech synthesis by lengthening the duration of the microsegments on the basis of the symbol string. Such manipulation in the time domain is carried out on the already-allocated microsegments. Therefore, no additional speech units are required for realizing final lengthening, which keeps the memory location requirements low.

Because stresses are detected by means of the analysis and that the phoneme string is extended in such places with stress symbols for different stress levels to form a string of symbols, a change taking place in the duration of the speech sounds on the microsegments with stress symbols as the microsegments are concatenated, the types of stress occurring in natural speech are simulated. The main information about word stress realized by durational modification sis found in a lexicon. The stress then to be selected for sentence accents which carry an intonation movement is determined by means of the analysis of the text to be output as speech on the basis of its syntax and predetermined rules. Depending on the determined stress, the respective microsegment is replayed unabbreviated or abbreviated by omitting certain sections of the microsegment. For generating a highly variable speech at acceptable computing expenditure, it was found that five levels of shortening are adequate for vowel microsegments, so that six playback durations are possible. Such levels of shortening are marked on the previously stored microsegment and are controlled in the context sensitive text analysis in accordance with the result of the analysis; i.e., in accordance with the stress level to be selected.

Both the lengthening of the playback duration with phrase-final syllables and the various levels of shortening for stress levels are preferably realized with the same leels of shortening in the microsegments. As opposed to syllables to be stressed where lengthening in terms of time is uniformly distributed across all microsegments, provision is made for progressive lengthening of the playback duration in connection with phrase-final syllables, namely of speech units noted in the written language with the punctuation marks comma, semicolon, period and colon. This is accomplished by increasing the playback duration of the microsegments in connection with phrase-final syllables in each case by one step, starting with the second microsegment.

For example, with the German-language sentence "Er hat in Paris gewohnt" [He has resided in Paris], the last syllable "-wohnt" —pronounced /vo:nt/—is lengthened in such a way that the microsegment string represented in the first line of the table is converted with the normal duration level—if said syllable is not at the end of the phrase—specified in brackets to the microsegment string represented in the third line in accordance with the lengthening symbols. The value range for the levels of duration reaches from 1 to 6, higher numbers conforming to longer durations. Symbol "%" does not generate a change in duration.

| | | | | | | | |
|---|---|---|---|---|---|---|---|
| Normal | [2v]o | v[50] | [50]n | [2n]t | t[2t] | [2t] | . . . |
| Symbol | % | % | +1 | +2 | +3 | +4 | |
| Lengthened | [2v]o | v[50] | [60]n | [4n]t | t[5t] | [6t] | . . . |

The process is similar in other languages or dialects. In English, final lengthening, for example of the sentence "He saw a shrimp" would be realized with microsegments for the last word as follows:

| | | | | | | | | |
|---|---|---|---|---|---|---|---|---|
| Normal | t25]r | [2r]I | r[31] | [31]m | [2m]p | p[2p] | [2p] | . . . |
| Symbol | % | % | % | +1 | +2 | +3 | +4 | |
| Lengthened | [2S]r | [2r]I | r[31] | f41]m | [4m]p | p[5p] | [6p] | . . . |

With open syllables, i.e., with syllables ending with a vowel such as, for example, in "Er war da" [He was there] the playback duration of the second microsegment of "da" —pronounced /da:/—is increased by 2 steps:

| | | | | | |
|---|---|---|---|---|---|
| Normal | d[2d] | [2d]a | d[4a] | [4a] | . . . |
| Symbol | % | % | % | +2 | |
| Lengthened | d[2d] | [2d]a | d[4a] | [6a] | . . . |

This procedure is carried out until the longest duration stage (=6) has been reached.

The melody of spoken utterances is simulated by allocating intonations based on the analysis and by extending the phoneme string in such places with intonation symbols to form a symbol string, which is used for changing the fundamental frequency of defined parts of the periods of microsegments, which is applied in the time domain when the microsegments are concatenated. The change in fundamental frequency preferably takes place by skipping and adding defined sample values. The previously recorded voiced microsegments; i.e., vowels and sonorants are marked for this purpose. The first part of each pitch period, in which the vocal folds are together and which contains important spectral information, is processed separately from the second, less important part, in which the vocal folds are apart. The markings are set in such a way that during signal output, only the second part of each period—which are spectrally not critical—are shortened or lengthened for changes in fundamental frequency. This does not significantly increase the memory requirements for reproducing intonations in the speech output, and the computing expenditure is kept low due to the manipulation in the time domain.

When concatenating a sequence of different microsegments for speech synthesis, an acoustic transition between successive microsegments that is free of interferences to the highest possible degree is achieved in that the microsegments start with the first sample value after the first positive zero crossing, i.e., a zero crossing with a positive signal increase, and end with the last sample value before the last positive zero crossing. The digitally stored series of statistical values of the micro-segments are thus concatenated almost without discontinuities, which prevents clicks caused by digital leaps. Furthermore, closure phases of plosives or word interruptions and general speech pauses represented by digital zeros can be inserted at any time without introducing discontinuities.

BRIEF DESCRIPTION OF THE DRAWINGS

An exemplified embodiment of the invention is described in greater detail in the following with the help of the drawings, in which.

DETAILED DESCRIPTION OF THE PREFERRED EMBODIMENT

Figure 1:
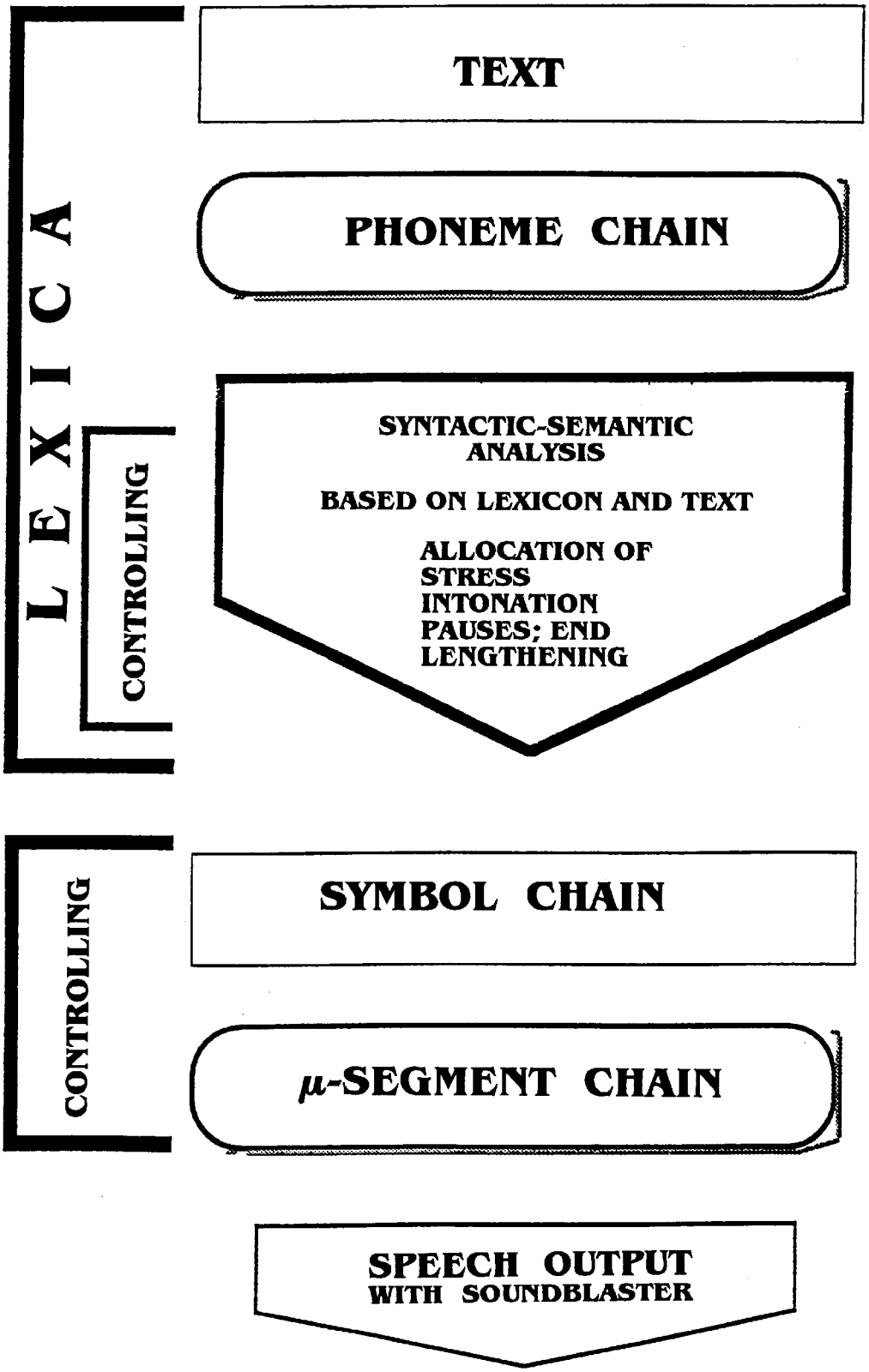
FIG. 1 shows a flow diagram of the speech-synthesis process.

The process steps of the speech-synthesis process as defined by the invention are represented in FIG. 1 in a flow diagram. The input for the speech-synthesis system is a text, for example a text file. By means of a lexicon stored in the computer, a phoneme string is associated with the words of the text, said phoneme string representing the pronunciation of the respective word. In the language, particularly in the German language, words are newly formed frequently by compounding words and word components, e.g. with prefixes and suffixes. The pronunciation of words such as "Hausbau" [=house construction], "Bebauung" [=constructing upon], "bebaubar" [=suitable for construction purposes] can be derived from a word stem, here "bau", and connected with the pronunciation of the pre- and suffixes. Also connecting sounds such as "s" in "Gerichtsdiener" [=bailiff], "es" in "Landessportschule" [=state sports school] and "n" in "Grubenarbeiter" [=mine worker] can be taken into account in this connection as well. Therefore, in case a word is not included in the lexicon, various substitute mechanisms are engaged in order to verify the pronunciation of the word. An attempt is made first in this connection to compound the word searched for from other entries of the lexicon as described above. If this is not possible, an attempt is made to arrive at a pronunciation via a lexicon of syllables containing syllables with their pronunciations. If this should fail as well, rules are available by which sequences of letters have to be converted to phoneme sequences.

Below the phoneme string generated as shown above, FIG. 1 shows the syntactic-semantic analysis. In addition to the known data on pronunciation contained in the lexicon, said analysis contains syntactic and morphological information which, together with certain key words of the text, permits a local linguistic analysis with phrase boundaries and accented words. As output, the The phoneme string originating from the pronunciation data of the lexicon is modified based on said analysis and additional information about pause duration and intonation values is inserted. A phoneme-based, prosodically enriched symbol string is formed, which supplies the input for the actual speech output.

For example, the syntactic-semantic analysis takes into account word accents, phrase boundaries and intonation. The gradations in the stress level of syllables within a word are marked in the lexicon entries. The stess level for the reproduction of the microsegments forming said word are thus preset. The stress level stage of the microsegments of a syllable results from the following:

The phonological length of a sound, which is marked for each phoneme, for example /e:/ for a long e' in /fo'ne:tIK/ [=phonetics];

the stress of the syllable, which is marked in the phoneme string before the stressed syllable, for example /fo'ne:tIK/;

the rules for phrase-final lengthening and, if need be, from other rules that are based on the sequence of accented syllables such as, for example, the lengthening of two stressed successive syllables.

The phrase boundaries, where the phrase-final lengthening takes place in addition to certain intonatory processes, are determined by linguistic analysis. The boundary of phrases is determined by given rules based on the sequence of parts of speech. The conversion of the intonation is based on an intonation and pause description system, in which a basic distinction is made between intonation curves taking place at phrase boundaries (rising, falling, remaining constant, falling-rising), and those which are located around accents (low, high, rising, falling). The intonation curves are allocated based on the syntactic and morpholigic analysis, including defined key words and key signs in the text. For example, questions starting with a verb (recognizable by the question mark at the end and by the information that the first word of the sentence is a finite verb) have a low accent tone and a high-rising boundary tone. Normal statements have a high accent tone and a falling final phrase boundary. The intonation curve is generated according to preset rules.

For the actual output of speech, the phoneme-based symbol string is converted into a microsegment sequence. The conversion of a sequence with two phonemes into microsegment sequences takes place via a set of rules by which a sequence of microsegments is allocated to each phoneme sequence.

In said process, the additional information relating to stress, pause duration, final lengthening and intonation is taken into account when the successive microsegments specified by the microsegment sequence are concatenated. The microsegment sequence is modified exclusively in the time domain. In the series of statistical values signal of the concatenated microsegments, for example, a speech pause is realized by inserting digital zeros in the place marked by a corresponding pause symbol.

The output of speech then takes place by digital-to-analog conversion, for example via a "soundblaster" card arranged in the computer.

Figure 2:
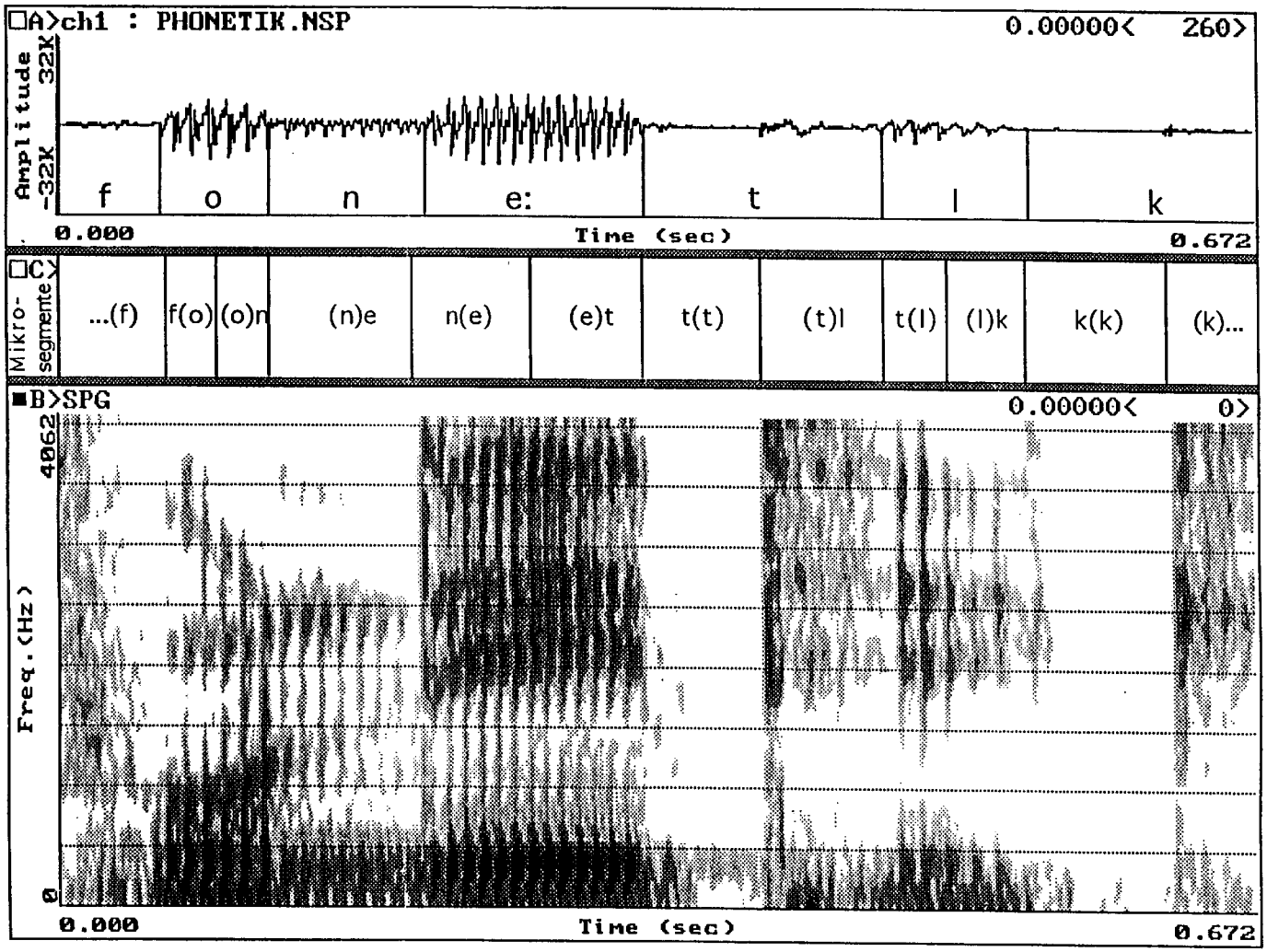
FIG. 2 shows a spectrogram and speech pressure waveform of the word "Phonetik" [phonetics]

For the word example "Phonetik" [phonetics], FIG. 2 shows in the upper part a spectrogram and in the lower part the speech pressure waveform associated with the latter. The word "Phonetik" is shown in symbols as a phoneme sequence between slashes as follows: /fo'ne:tIk/. This phoneme sequence is plotted in the upper part of FIG. 2 on the abscissa representing the time axis. The ordinate of the spectrogram in FIG. 2 denotes the frequency content of the speech signal, the degree of blackening being proportional to the amplitude of the corresponding frequency. In the speech pressure waveform shown in FIG. 2 at the top, the ordinate corresponds with the instantaneous amplitude of the signal. The microsegment boundaries are shown in the center field by vertical lines. The letter grammalogs shown therein denote the symbolic representation of the respective microsegment. The word example "Phonetik" thus consists of twelve microsegments.

The naming conventions of the microsegments are chosen in such a way that the sounds outside the brackets characterize the context, the current sound being indicated in brackets. The transitions of the speech sounds depending on their context are taken into account in this way.

The consonantal segments . . . (f) and (n)e are segmented on the respective sound boundaries. The plosives /t/ and /k/ are divided in a closure phase (t(t) and k(k), which is digitally reproduced by sample values set to zero and which is used for all plosives; as well as in a short release phase (here: (t)I and (k) . . . ), which is context-sensitive. The vowels each are split into vowel halves, whereby the cutting points are disposed at the start and in the middle of the vowel.

Figure 3:
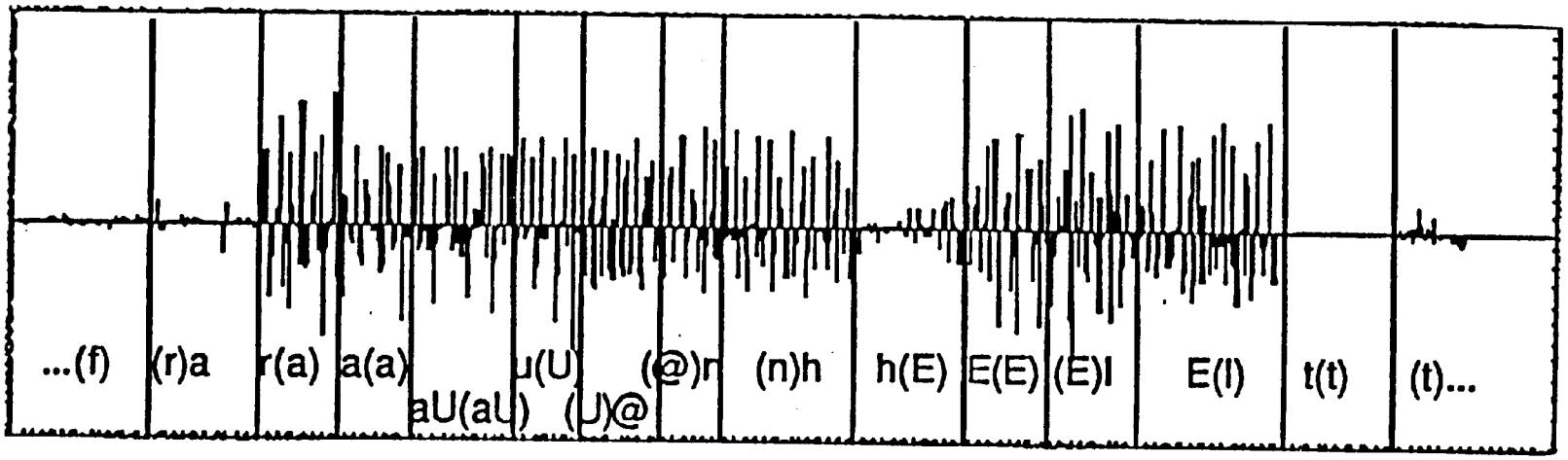
FIG. 3 shows the word "Frauenheld" [lady's man] in the time domain.

FIG. 3 shows another word example "Frauenheld" [lady's man] in the time domain. The phoneme sequence is stated by /fraU@nhElt/. The word shown in FIG. 3 comprises 15 microsegments, quasi-stationary microsegments occurring here as well. The first two microsegments . . . (f) and (r)a are consonantal segments; their context is specified only toward one side. Vowel half r(a), which comprises a transition of the velar articulation place to the middle of the "a", is followed by the start position a(a) of the diphthong /aU/. aU(aU) contains the perceptually important transition between the start position and the end position U(U). (U)@ contains the transition from /U/ to /@/, which normally should be followed by @(@). This, however, would make the duration of /@/ too long, so this segment is omitted at /@/ and /6/ for duration reasons and only the second vowel half (@)n is played back. (n)h represents a consonantal segment. Other than with vowels, the transition of consonants to /h/ is not specified. Therefore, no segment n/h/ exists. (h)E contains the aspirated part of vowel /E/, which is followed by the quasi-stationary E(E). (E)l contains the second vowel half of /E/ with the transition to the dental articulation place. E(l) is a consonantal microsegment, where only the pre-context is specified. The /t/ is divided in a closure phase t(t) and a release phase (t).., which leads into silence ( . . . ).

Figure 4:
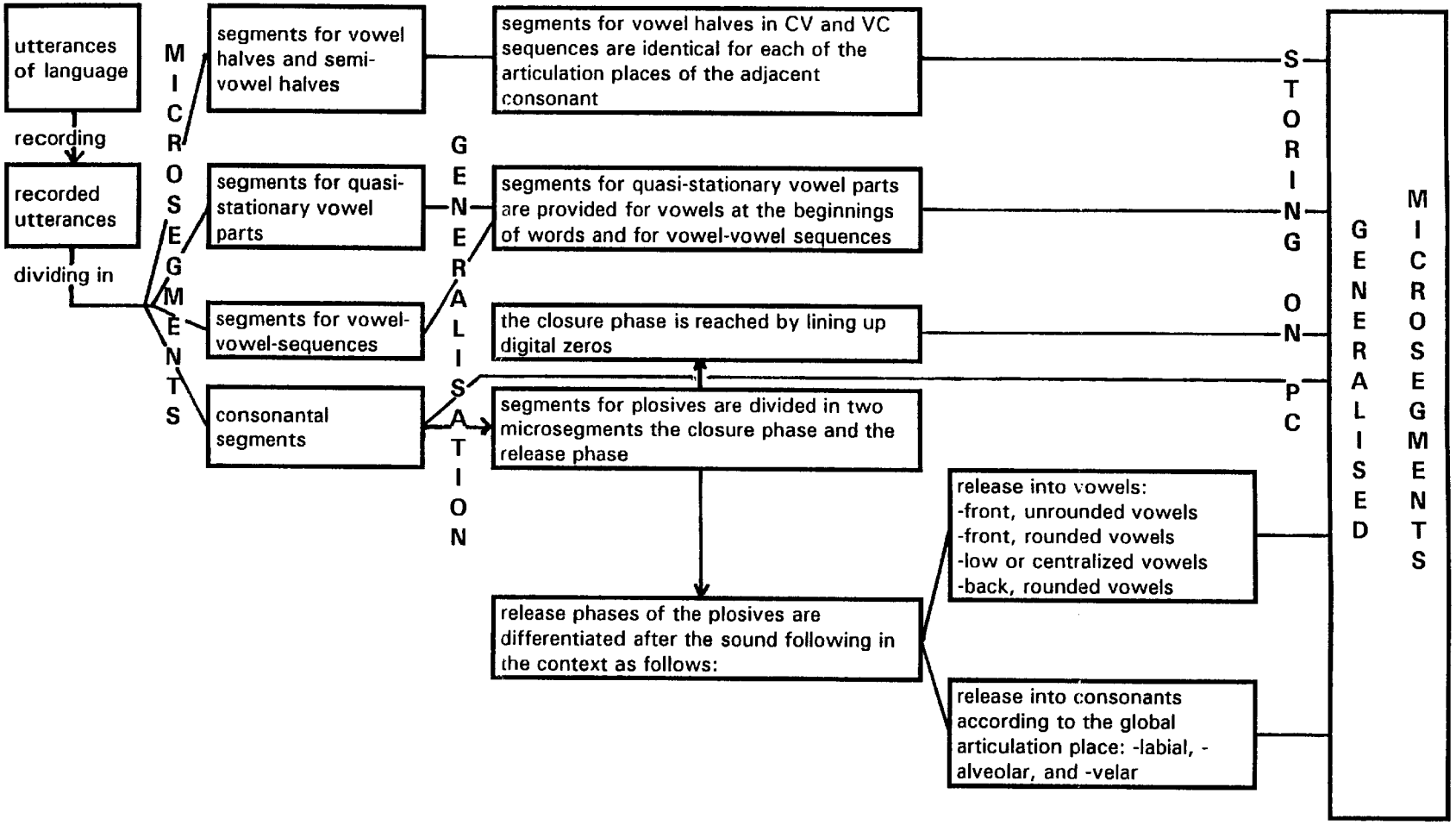
FIG. 4 shows a detailed flow diagram of the process according to the invention.
Figure 5:
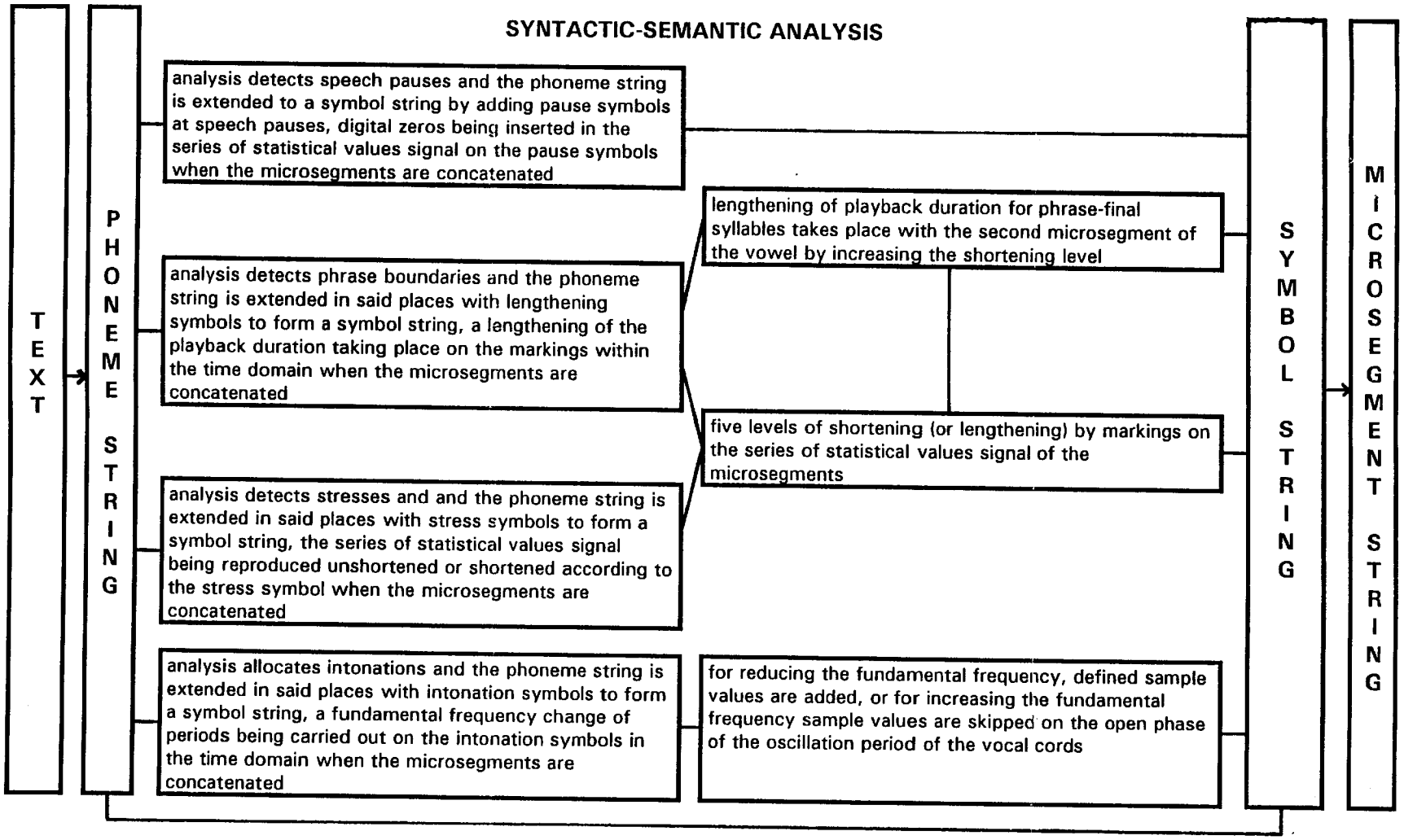
FIG. 5 shows a flow diagram of the syntactic-semantic analysis of the process according to the invention.

FIG. 4 shows a detailed flow diagram of the process according to the invention, in which utterances are divided into microsegments and stored on a PC. FIG. 5 shows a syntactic-semantic analysis according to the invention, in which text is transformed into a microsegment string.

According to the invention, the multitude of possible articulation places is limited to three important regions. The combination of the groups is based on the similar movements carried out for forming the sounds of the articulators. The spectral transitions between the sounds are similar to each other within each of the three groups specified in table 1 because of the comparable articulator movements.

TABLE 1

| | Articulators and articulation places and their designations | | |
|---|---|---|---|
| Summary | Designation | Articulator | Articulation Place |
| Labial | Bilabial | Lower lip | Upper lip |
| | Labiodental | Lower lip | Upper incisors |
| Alveolar | Dental | Tip of tongue | Upper incisors |
| | Alveolar | Tip or blade of tongue | Perineum of teeth, alveoli |
| Velar | Palatal | Anterior dorsal region of tongue | Hard palate, palatum |
| | Velar | Medium dorsal region of tongue | Soft palate, velum |

TABLE 1-continued

| Summary | Articulators and articulation places and their designations | | |
|---|---|---|---|
| | Designation | Articulator | Articulation Place |
| | Uvular | Posterior dorsal region of tongue | Uvula |
| | Pharyngeal | Root of tongue | Posterior pharyngeal wall |
| | Glottal | Vocal fold | Vocal fold |

Therefore, for each vowel only one microsegment per articulation place of the preceding consonant (=1st half of the vowel) and one microsegment per articulation place of the following consonant (=2nd half of the vowel) is used. For example, the same two vowel halves can be used for each of the following syllables because the starting consonant is formed in each case with the closing of the two lips (bilabial) and the final consonant by lifting the tip of the tongue up to the perineum of the teeth (=alveolar):

| | | | | |
|---|---|---|---|---|
| /pat | pad | pas | paz | pa(ts) |
| /bat | bad | bas | baz | ba(ts) |
| /mat | mad | mas | maz | ma(ts) |
| /(pf)at | (pf)ad | (pf)as | (pf)az | (pf)a(ts) |
| /fat | fad | fas | faz | fa (ts) |
| /vat | vad | vas | vaz | va(ts) |

Continuation:

| | | | |
|---|---|---|---|
| pa(tS) | pa(dZ) | (pan) | pal/ |
| ba(tS) | ba(dZ) | (ban) | bal/ |
| ma(tS) | ma(dZ) | (man) | mal/ |
| (pf)a(tS) | (pf)a(dz) | (pf)an) | (pf)ah/ |
| fa(tS) | fa(dZ) | (fan) | fal/ |
| va(tS) | va(dZ) | (van) | val/. |

In addition to the labial and alveolar articulation places there is the velar one. Further generalization is achieved by grouping the postalveolar consonants /S/ (as in stitch) and /z/ (as in fee) with the alveolar, and the labiodental consonants /f/ and /v/ with the labial ones, so that also /fa(tS)/, /va(tS)/, /fa(dZ)/ and /va(dZ)/ may contain the same vowel segments as shown above. Therefore, the following applies to the microsegments of the exemplified syllables shown above: p(a)=b(a)=m(a)a=(pf)(a)=f(a)=v(a); and (a)t=(a)d=(a)s=(a)z=(a)(ts)=(a)(tS)=(a)(dZ)=(a)n=(a)1.

In addition to the vowel halves described above for vowel "a", the following microsegments belong to the category of vowel halves and semi-vowel halves as well:

The first halves of the monophthongs /i:, I, e:, E, E:, a(:), O, o:, U, u:, y:, Y, 2:, 9, @, 6/, which appear after a labial, alveolar or velar sound;

the second halves of the monophthongs /1:, I, e:, E, E:, a(:), O, o:, U, u:, y:, Y, 2:, 9, @, 6/ before a labial, alveolar or velar sound;

first and second halves of the consonants /h/ and /j/ from the contexts:

nonopen unrounded front vowel /i:, I, e, E, E:/,
nonopen rounded front vowel /y:, Y, 2:, 9/,
open unrounded central vowel /a(:), @, 6/,
nonopen rounded back vowel /O, o:, U, u:/.

Furthermore, segments are required for quasi-stationary vowel parts cut out from the middle of a long vowel realization. Such microsegments are inserted in the following positions:

word-initially;

after the semi-vowel segments /h/, /j/, as well as around /?/;

for final lengthening when complex sound movements have to be realized on phrase-final syllables;

between non-diphthongal vowel-vowel sequences; as well as in diphthongs as target positions.

The multiplication effect of sound combinatorics caused in diphone-synthesis is substantially reduced by the multiple use of microsegments in different sound contexts without impairing the dynamics of articulation.

With the generalization in the speech units as defined by the invention, 266 microsegments are theoretically sufficient for German, namely 3 articulation places, one stationary, and final for each of 16 vowels; 6 plosives for 3 consonant groups after the articulation place and for 4 vowel groups; and /h/, /j/ and /?/ for more differentiated vowel groups. For enhancing the quality of the sound of the synthetically generated speech, the number of microsegments required for the German language should amount to between 320 and 350 depending on the sound differentiation. Due to the fact that the microsegments are relatively short in terms of time, this leads to a memory requirement of about 700 kB at 8 bit resolution and 22 kHz sampling rate. As compared to the known diphone-synthesis this supplies a reduction by a factor 12 to 32.

For further enhancing the sound quality of the synthetically generated speech, provision is made for providing markings in the individual microsegments, such markings permitting a shortening, lengthening or frequency change on the microsegment in the time domain. The markings are set on the zero crossings with positive rise of the time signal of the microsegment. A total number of five levels of shortening are realized, so together with the unshortened reproduction the microsegment has six different levels of playback duration. The following procedure is employed for the reductions: With a vowel segment extending from an articulation place to the middle of the vowel, the start position, and with a vowel segment extending from the middle of the vowel to the following articulation place, the end position (=articulation place of the following consonant) is always reached, whereas the movement to or from the "vowel center" is shortened. This method permits a further generalized application of the microsegments: The same signal units supply the basic elements for long and short sounds both in stressed and unstressed syllables. The reductions in words which, in terms of the sentence, are unaccented, are derived from the same microsegments as well, the latter being recorded in sentence-accentuated position.

Furthermore, the intonation of linguistic utterances can be generated by a change in the fundamental frequency of the periodic parts of vowels and sonorants. This is carried out by manipulating the fundamental frequency of the microsegment within the time domain, by which hardly any loss is caused in terms of sound quality. The spectrally important part (1st part=phase of the closed glottis) of each voiced period, said part carrying the important information, and the less important second part (=phase of the open glottis) are treated separately. The first voiced period and the "closed phase" (1st part of the priod) contained therein, which phase has to be maintained constant, are marked. Due to the monotonous quality of the speech it is possible to automatically find all other periods in the microsegment and to thus define the closed phases. In the output of the signal, the spectrally noncritical "open phases" are shortened proportionally for increasing the frequency, which effects a reduction in the overall duration of the periods. When the frequency is lowered, the open phase is extended in proportion to the degree of reduction. Frequency increases and frequency reductions are uniformly carried out via one microsegment. This causes the intonation curve to develop in steps, which is largely smoothened by the natural "auditory integration" of the listening human. It is basically possible, however, to change the frequencies also within a microsegment, up to the manipulation of individual periods.

The recording and the segmentation procedure of microsegments as well as the speech reproduction are described in the following.

Individual words containing the respective sound combinations are spoken by a person monotonously and stressed. Such actually spoken utterances are recorded and digitalized. The microsegments are cut from such digitalized speech utterances. The cutting points of the consonantal segments are selected in such a way that the influences of adjacent sounds on the microsegment boundaries are minimized and the transition to the next sound is no longer exactly audible. The vowel halves are cut from the environment of voiced plosives, noisy components of the closure phase being eliminated. The quasi-stationary vowel components are separated from the middle of long sounds.

All segments are cut from the digital signal of the utterances contained therein in such a way that the segments start with the first sample value after the first positive zero crossing and end with the last sample value before the last positive zero crossing. Clicks are avoided in this way.

For limiting the memory requirements, the digital signal has a bandwidth of, for example 8 bit, and a sampling rate of 22 kHz.

The microsegments so cut out are addressed according to the sound and the context and stored in a memory.

A text to be output as speech is supplied to the system with the appropriate address sequence. The selection of the addresses is determined by the sound sequence. The microsegments are read from the memory according to said address sequence and concatenated. This digital time series is converted into an analog signal in a digital-to-analog converter, for example in a so-called soundblaster card, and said signal can be output via speech output devices, for example via a loudspeaker or headsets.

The speech-synthesis system as defined by the invention can be realized on a common PC, with 4 MB operating memory. The vocabulary realizable with the system is practically unlimited. The speech is clearly comprehensible, and the computing expenditure for modifications of the microsegments, for example reductions or changes in the fundamental frequency, is low as well, because the speech signal is processed within the time domain.

What is claimed is:

1. A digital speech synthesis process, in which utterances of a language are recorded first, the recorded utterances are divided in speech segments, and the segments are stored allocated to defined phonemes, a text to be output as speech then being converted into a phoneme string and the stored segments are successively output in a sequence defined by said phoneme string, and an analysis of the text to be output as speech is carried out and thus provided information supplementing the phoneme string, such information modifying the series of statistical values signal of the speech segments to be concatenated for the speech output, characterized in that microsegments are used as speech segments, such microsegments consisting of:

Segments for vowel halves and semi-vowel halves, vowels between consonants being split into two microsegments, a first vowel half beginning shortly after the beginning of the vowel and extending up to the middle of the vowel, and a second vowel half extending from the middle of the vowel up to just before the end of the vowel, whereby the segments for vowel halves and semi-vowel halves in a consonant-vowel or vowel-consonant sequence are identical for each of the articulation places of the adjacent consonant, namely labial, alveolar or velar;

Segments for quasi-stationary vowel parts, such segments being cut from the middle of a vowel;

Consonantal segments beginning shortly after the front sound boundary and ending shortly before the rear sound boundary; and Segments for vowel-vowel sequences, which are cut from the middle of a vowel-vowel transition.

2. The speech-synthesis process according to claim 1, characterized in that the segments for quasi-stationary vowel parts are provided for vowels at the beginnings of words and for vowel-vowel sequences as well as for the sounds /h/, /j/ and glottal stops.

3. The speech-synthesis process according to claim 1, characterized in that the consonantal segments for plosives are divided in two microsegments: a first segment comprising the closure phase, and a second segment comprising the release phase.

4. The speech-synthesis process according to claim 3, characterized in that the closure phase is reached for all plosives by lining up digital zeros.

5. The speech-synthesis process according to claim 3, further comprising the step of differentiating the release phases of the plosives are after the sound following in the context, wherein vowels are differentiated into the following four groups:
Front, unrounded vowels;
front rounded vowels;
low or centralized vowels; and
back, rounded vowels;

and wherein consonants are differentiated according to a global articulation place into the following three groups:
labial;
alveolar; and
velar.

6. The speech-synthesis process according to claim 1, characterized in that the analysis detects speech pauses and the phoneme string is extended to a symbol string by adding pause symbols at speech pauses, digital zeros being inserted in the series of statistical values signal on the pause symbols when the microsegments are concatenated.

7. The speech-synthesis process according to claim 1, characterized in that the analysis detects phrase boundaries and that the phoneme string is extended in said places with lengthening symbols to form a symbol string, a lengthening of the playback duration taking place on the markings within the time domain when the microsegments are concatenated.

8. The speech-synthesis process according to claim 1, characterized in that the analysis detects stresses and that the phoneme string is extended in said places with stress symbols for different stress values to form a symbol string, the series of statistical values signal being reproduced unshortened or shortened according to the stress symbol when the microsegments are concatenated.

9. The speech-synthesis process according to claim 7 characterized in that provision is made for 5 levels of shortening by markings on the series of statistical values signal of the microsegments.

10. The speech-synthesis process according to claim 1, characterized in that the analysis allocates intonations and that the phoneme string is extended in said places with intonation symbols to form a symbol string, a fundamental frequency change of certain components of the periods being carried out on the intonation symbols in the time domain when the microsegments are concatenated.

11. The speech-synthesis process according to claim 10, characterized in that for reducing the fundamental frequency, defined sample values are added, or for increasing the fundamental frequency sample values are skipped in the open phase of the oscillation period of the vocal cords.

12. The speech-synthesis process according to claim 7, characterized in that the symbol string is converted into a microsegment string representing the sequence of microsegments and their modifications, taking into account the sequence phonemes and symbols.

13. The speech-synthesis process according to claim 1, characterized in that the microsegments start with the first sample value after the first positive zero crossing and end with the last sample value before the last positive zero crossing.

14. A digital speech synthesis process, in which utterances of a language are recorded first, the recorded utterances are divided in speech segments, and the segments are stored allocated to defined phonemes, a text to be output as speech then being converted into a phoneme string and the stored segments are successively output in a sequence defined by said phoneme string, and an analysis of the text to be output as speech is carried out and thus provided information supplementing the phoneme string, such information modifying the series of statistical values signal of the speech segments to be concatenated for the speech output, characterized in that microsegments are used as speech segments, such microsegments consisting of:

Segments for vowel halves and semi-vowel halves, vowels between consonants being split into two microsegments, a first vowel half beginning shortly after the beginning of the vowel and extending up to the middle of the vowel, and a second vowel half extending from the middle of the vowel up to just before the end of the vowel;

Segments for quasi-stationary vowel parts, such segments being cut from the middle of a vowel;

Consonantal segments beginning shortly after the front sound boundary and ending shortly before the rear sound boundary; and Segments for vowel-vowel sequences, which are cut from the middle of a vowel-vowel transition wherein the analysis detects phrase boundaries and the phoneme string is extended in said places with lengthening symbols to form a symbol string, a lengthening of the playback duration taking place on the markings within the time domain when the microsegments are concatenated; and wherein the lengthening of the playback duration for phrase-final syllables takes place with closed syllables starting with the second microsegment of the vowel by increasing the shortening level for a longer playback duration in each case by one step, and with open syllables for the second microsegment of the vowel by increasing the shortening level for a longer playback duration by two steps.

* * * * *